US005133525A

United States Patent [19]

Good

[11] Patent Number: 5,133,525

[45] Date of Patent: Jul. 28, 1992

[54] CAN SUPPORT DEVICE

[76] Inventor: Brian G. Good, 30 Essex La., Trumbull, Conn. 06611

[21] Appl. No.: 739,163

[22] Filed: Aug. 1, 1991

[51] Int. Cl.[5] ..... E06C 7/14

[52] U.S. Cl. ..... 248/210; 182/121; 182/129

[58] Field of Search ..... 182/121, 122, 129; 248/210, 211, 238

[56] References Cited

U.S. PATENT DOCUMENTS 3,940,824 3/1976 Gioia ..... 248/210

4,433,822 2/1984 Caggiano ..... 248/210

*Primary Examiner*—Reinaldo P. Machado

*Attorney, Agent, or Firm*—Daniel Jay Tick

[57] ABSTRACT

A can supporting device supports a can from the rung of a ladder when the side rails of the ladder abut an upright supporting surface and has a support band of L configuration with first and second arms. The first arm has a hooked free end for hooking onto a rung of the ladder. The free end of the second arm has a retainer for a can resting on the second arm. A circular band is affixed to the first arm of the support band and encircles and thereby restricts movement of the can. An abutting bracket is affixed to the support band in movable relation to the support band into abutment with a rung of the ladder. This stabilizes the position of the supporting device and the can.

10 Claims, 3 Drawing Sheets

CAN SUPPORT DEVICE

BACKGROUND OF THE INVENTION

The present invention relates to a can supporting device. More particularly, the invention relates to a can supporting device for supporting a can from a rung of a ladder.

Painters working on high ladders most often support paint cans from convenient rungs of such ladders so that the paint is accessible. Known devices for hanging paint cans from the rungs of ladders are unstable and permit swinging of the can thereby leading to spilling of paint from the cans and possible dropping of paint brushes and the paint cans.

The principal object of the invention is to provide a can supporting device which is stabilized in position with facility, convenience and rapidity by a user.

An object of the invention is to provide a can supporting device of simple structure, which is inexpensive in manufacture and is used with facility, convenience, ease and speed.

Another object of the invention is to provide a can supporting device for supporting a can from a rung of a ladder with stability thereby preventing the spilling of the contents of the can.

Still another object of the invention is to provide a can supporting device of simple structure for supporting a paint can from the rung of a ladder, which device is stabilized in position with facility, convenience and rapidity by a user.

Yet another object of the invention is to provide a can supporting device which functions efficiently, effectively and reliably to stabilize a can supported thereby and thus prevent spilling of the contents of such can.

Another object of the invention is to provide a can supporting device which functions efficiently, effectively and reliably to prevent a paint can supported thereby from spilling any paint and which device may be used with facility to provide such results.

Still another object of the invention is to provide a can supporting device which is easily carried with a paint can mounted thereon, as a unit, up and down a ladder freely, without the need to separate the can from the device in order to carry either.

Yet another object of the invention is to provide a can supporting device which is collapsible for easy storage when not in use.

Another object of the invention is to provide a paint can supporting device which supports a paint can so firmly and securely that the entire device may be moved with the can secured thereto by grasping the wire handle of the paint can.

BRIEF SUMMARY OF THE INVENTION

In accordance with the invention, a can supporting device for supporting a can from a rung of a ladder used in a manner whereby the side rails of the ladder abut a substantially upright supporting surface, comprises a support band of substantially L configuration having first and second arms, the first arm having a hooked free end for hooking onto a rung of the ladder and the second arm having a free end, the free end of the second arm having means for retaining a can resting on the second arm. A substantially circular band having a latch or fastener is affixed to the first arm of the support band and encircles and thereby restricts movement of the can. Abutting means is affixed to the support band in a manner whereby the abutting means is movable relative to the support band into abutment with a rung of the ladder thereby stabilizing the position of the supporting device and the can.

The first arm of the support band is substantially vertical and the second arm of the support band is substantially horizontal. The abutting means comprises a member extending adjacent and substantially parallel to the second arm of the support band and mounting means for slidably mounting the member against the undersurface of the second arm of the support member in a manner whereby the member is adjustably extendible beyond the first and second arms and is releasably fastened in a desired position.

Can retaining means at the free end of the second arm of the support band retains a can resting on the second arm.

In accordance with the invention, a can supporting device for supporting a can from a rung of a ladder used in a manner whereby the side rails of the ladder abut a substantially upright supporting surface, comprises a support band of substantially L configuration having first and second arms, the first arm having a hooked free end for hooking onto a rung of the ladder and the second arm having a free end, the free end of the second arm having means for retaining a can resting on the second arm whereby a can is supportable on the second arm. A substantially circular band is affixed to the first arm of the support band for encircling and thereby restricting movement of the can. A bracket member extends adjacent and substantially parallel to the second arm of the support band. Clamping means slidably mounts the bracket member against the undersurface of the second arm of the support member in a manner whereby the bracket member is adjustably extendible beyond the first and second arms. Fastening means affixed to the first arm of the support band releasably fastens the bracket member in position relative to the support member whereby a user adjusts the bracket member in position to abut the supporting surface and releasably fastens the bracket member in position thereby stabilizing the position of the supporting device and the can.

The bracket member has a first arm slidably mounted in the clamping means adjacent and parallel to the second arm of the support band. The first arm has a first end in the clamping means and a spaced opposite second end spaced from the first arm of the support band.

A substantially L-shaped end member is provided on the second end of the first arm of the bracket member. The end member has a first arm conjoint with the first arm of the bracket member and a second arm substantially parallel to and spaced from the first arm of the support band.

In accordance with the invention, a can supporting device for supporting a can from a rung of a ladder, comprises a support band of substantially L configuration having a substantially vertical arm having a free end with a hook formed therein and a substantially horizontal arm extending from the opposite end of the substantially vertical arm, the substantially horizontal arm having a free end. A substantially L-shaped first end member is provided on the free end of the substantially horizontal arm. The first end member has a first arm conjoint with the substantially horizontal arm of the support band and a second arm substantially parallel to and spaced from the substantially vertical arm of the support band. A substantially circular band affixed to the substantially vertical arm of the support band encircles and thereby restricts movement of a can. Clamping means is provided on the substantially horizontal arm of the support band. A bracket member is movably mounted in the clamping means. The bracket member has a first arm movably mounted in the clamping means adjacent and parallel to the substantially horizontal arm of the support band. The first arm has a first end in the clamping means and a spaced opposite second end spaced from the substantially vertical arm of the support band. A substantially L-shaped second end member is provided on the second end of the first arm of the bracket member. The second end member has a first arm conjoint with the first arm of the bracket member and a second arm substantially parallel to and spaced from the substantially vertical arm of the support band. Fastening means is affixed to the substantially vertical arm of the support band in operative proximity with the bracket member for releasably fastening the bracket member in position relative to the support band. Thus, when a can is placed within the circular band and rests on the substantially horizontal arm of the support band and the ladder is used by a user who leans the side rails of the ladder against a substantially upright supporting surface, the hook is hooked on a rung of the ladder and the user manually adjusts the position of the bracket member so that the second end member abuts a rung of the ladder and manually releasably fastens the bracket member in position by manually operating the fastening means thereby stabilizing the position of the supporting device and the can.

BRIEF DESCRIPTION OF THE DRAWINGS

In order that the invention may be readily carried into effect, it will now be described with reference to the accompanying drawings, wherein.

DETAILED DESCRIPTION OF PREFERRED EMBODIMENT

Figure 4:
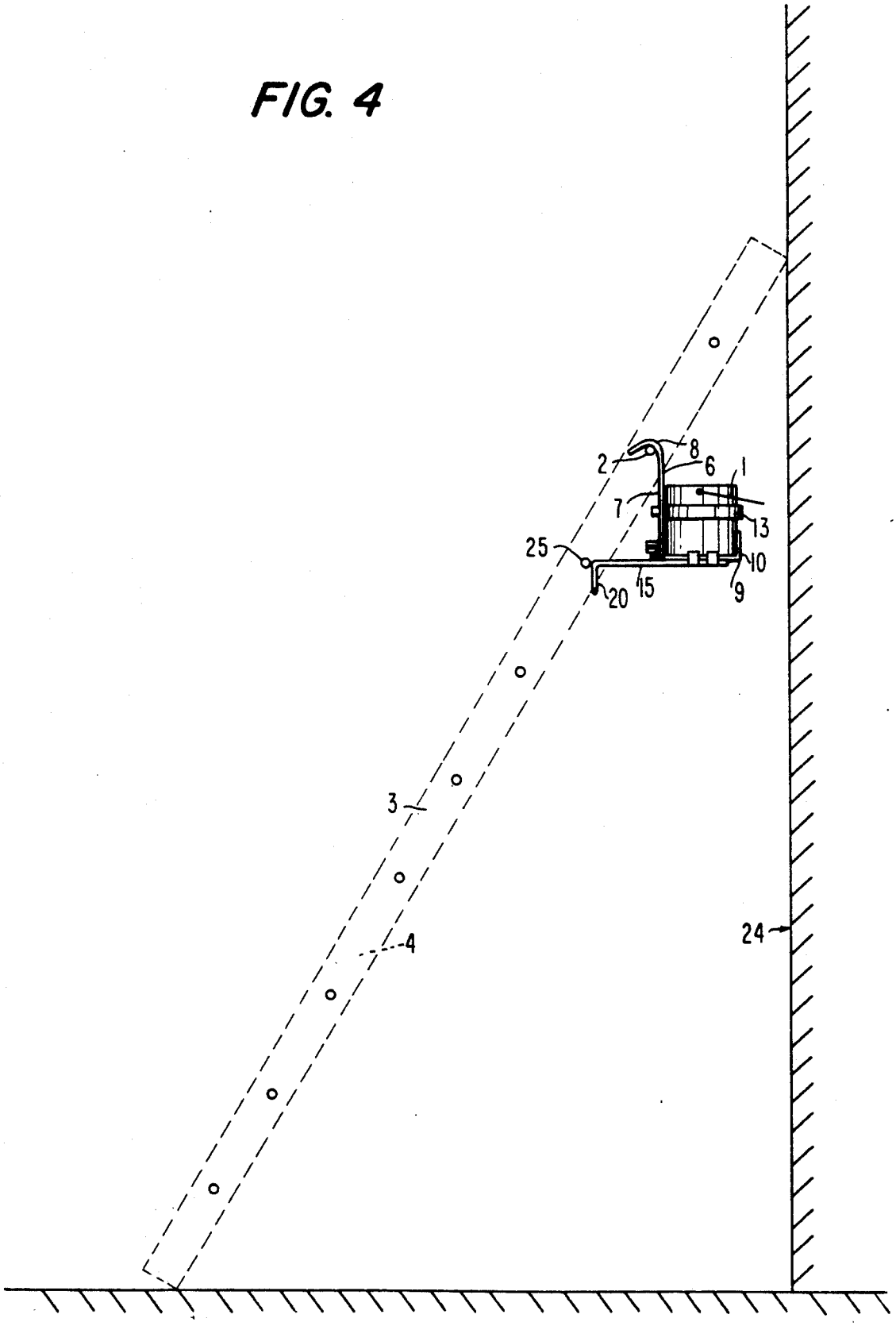
FIG. 4 is a schematic diagram, on a reduced scale, showing the embodiment of the invention in use.

The can supporting device of the invention supports a can 1 (FIG.4) such as, for example, a paint can, from a rung 2 of a ladder 3 having a side rail 4, as shown in FIG. 4, and a side rail 5 (not shown in the FIGS.).

Figure 1:
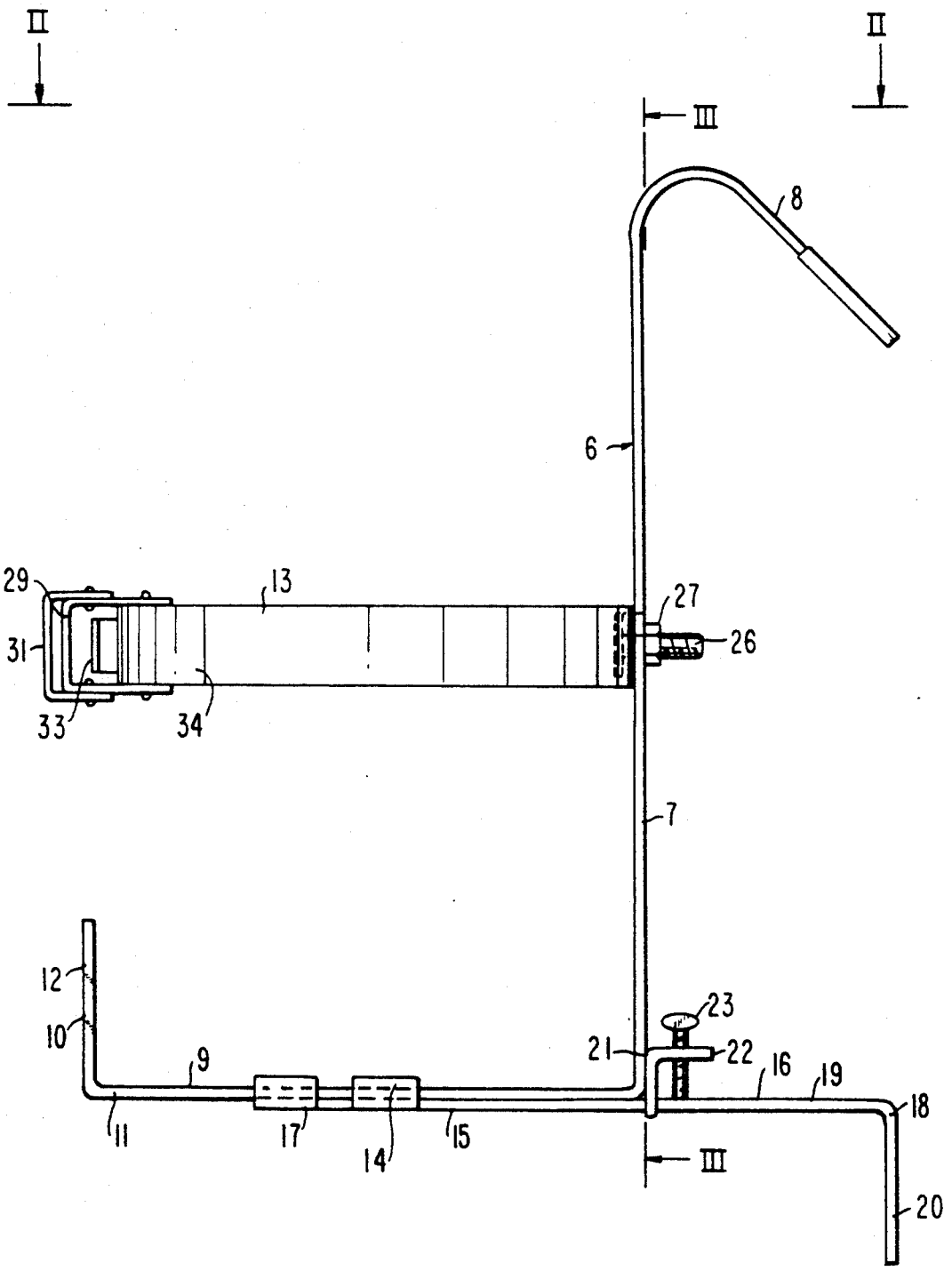
FIG. 1 is a schematic diagram of an embodiment of the can supporting device of the invention.
Figure 3:
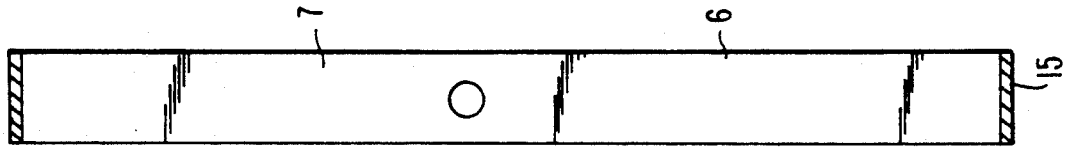
FIG. 3 is a view, taken along the lines III—III, of FIG. 1.
Figure 2:
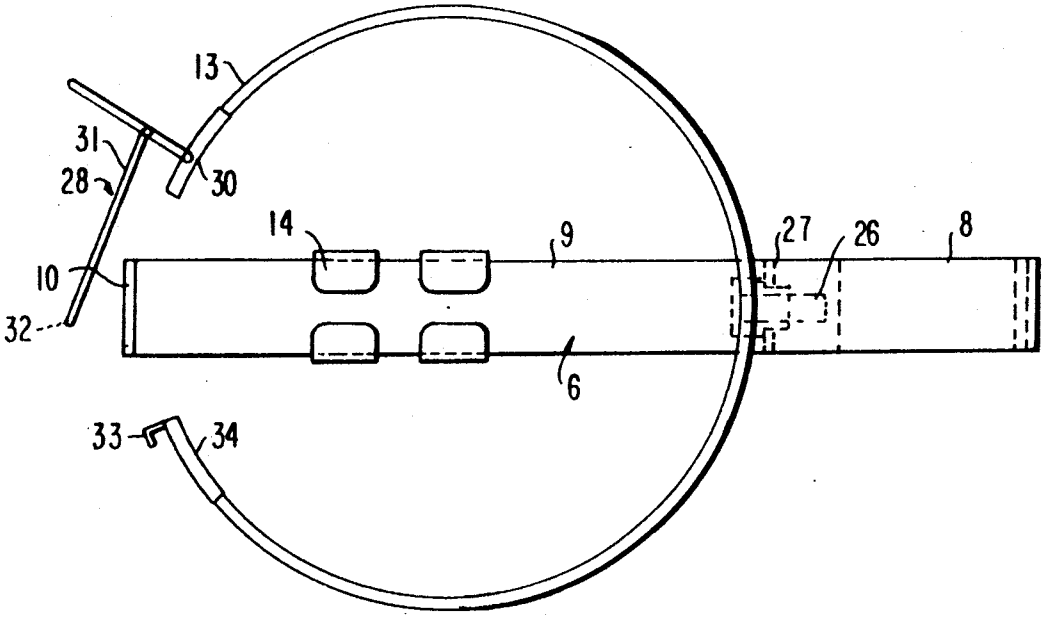
FIG. 2 is a view, taken along the lines II—II, of FIG, 1.

The device of the invention comprises a support band 6 of substantially L configuration (FIG. 1) having a substantially vertical arm 7 (FIGS. 1, 3 and 4) having a free end with a hook 8 formed therein, as shown in FIGS. 1, 2 and 4). The support band 6 also has a substantially horizontal arm 9 (FIGS. 1, 2 and 4) extending from the opposite end of the substantially vertical arm 7. The substantially horizontal arm 9 has a free end.

A substantially L-shaped first end member 10 is provided on the free end of the substantially horizontal arm 9, as shown in FIGS. 1, 2 and 4. The first end member 10 may be integrally formed with the substantially horizontal arm 9 or may be affixed thereto and has a first arm 11 conjoint with said substantially horizontal arm and a second arm 12 substantially parallel to and spaced from the substantially vertical arm 7, as shown in FIG. 1.

A substantially circular band 13 (FIGS. 1, 2 and 4) is affixed to the substantially vertical arm 7 of the support band 6 for encircling and thereby restricting movement of the can 1 (FIG. 4).

A clamp device 14 of any suitable known type (FIGS. 1 and 2) is provided on the substantially horizontal arm 9 of the support band 6. A bracket member 15 is movably mounted in the clamp device 14 and has a first arm 16 slidably or movably mounted in said clamp device adjacent and parallel to the substantially horizontal arm 9 of the support band 6, as shown in FIGS. 1 and 4. The first arm 16 has a first end 17 in the clamp device 14 (FIG. 1) and a spaced opposite second end spaced from the substantially vertical arm 7 of the support band 6.

A substantially L-shaped second end member 18 is provided on the second end of the first arm 16 of the bracket member 15, as shown in FIGS. 1 and 4. The second end member 18 has a first arm 19 conjoint with the first arm 16 of the bracket member, as shown in FIG. 1, and a second arm 20 substantially parallel to and spaced from the substantially vertical arm 7 of the support band 6. The second end member 18 may be integrally formed with the substantially horizontal arm 9 or may be affixed thereto.

A fastener 21 of any suitable known type (FIG. 1) is affixed to the substantially vertical arm 7 of the support band 6 in operative proximity with the bracket member 15 and functions to releasably fasten said bracket member in position relative to said support band. Thus, as illustrated, a suitable fastener may comprise, as shown in FIG. 1, a control bracket 22 affixed to the substantially vertical arm 7 of the support band 6, extending substantially parallel to the substantially horizontal arm 9 of said support band, and a thumb or set screw 23 threadedly coupled in as bore through said control bracket. Manual rotation of the set screw 23 in a counterclockwise direction releases the bracket member 15 for sliding movement along the substantially horizontal arm 9 and rotation of said set screw in a clockwise direction fastens said bracket member in position relative to said substantially horizontal arm.

Thus, the can 1 (FIG. 4) is placed within the circular band 13 and resting on the substantially horizontal arm 9 of the support band 6 and the ladder 3 is used by a user (not shown in the FIGS.) who leans the side rails 4 and 5 of said ladder against a substantially upright supporting surface 24 (FIG. 4), the hook 8 is hooked on a rung 2 of said ladder and the user manually adjusts the position of the bracket member 15 so that the second end member 18 thereof abuts a rung 25 of said ladder. The user then manually releasably fastens the bracket member 15 in position by manually operating the fastener 21 thereby stabilizing the position of the supporting device and the can 1.

The band 13 may be affixed to the substantially vertical arm 7 of the support band 6 by any suitable known means such as, for example, a cap screw 26 and a nut 27 (FIGS. 1 and 2). Furthermore, the band 13 may be fitted and secured around the can 1 (FIG. 4) by a latch 28 of any suitable known type (FIG. 2). Thus, for example, a first arm 29 of the latch may be pivotally affixed at one end to a free end 30 of the band 13 and a second arm 31 may be freely pivotally movable, at one end, along said first arm, as shown in FIG. 2. The spaced opposite end of the second arm 31 has a hole 32 formed therethrough. The first arm 29 is moved counterclockwise so that the second arm 31 is lowered until the hole 32 thereof accommodates a hook 33 at the other free end 34 of the band 13, after the band encircles a can 1 resting on the horizontal arm 9. When the first arm 29 is moved in a clockwise direction, the latch 28 releasably secures the band tightly about the can 1.

Although shown and described in what is believed to be the most practical and preferred embodiment, it is apparent that departures from the specific method and designs described and shown will suggest themselves to those skilled in the art and may be made without departing from the spirit and scope of the invention, I therefore, do not wish to restrict myself to the particular construction described and illustrated, but desire to avail myself of all modifications that may fall within the scope of the appended claims.

I claim:

1. A can supporting device for supporting a can from a rung of a ladder used in a manner whereby the side rails of said ladder abut a substantially upright supporting surface, said device comprising:

a support band of substantially L configuration having first and second arms, the first arm having a hooked free end for hooking onto a rung of said ladder and the second arm having a free end, said free end of said second arm having means for retaining a can resting on said second arm;

a substantially circular band affixed to said first arm of said support band for encircling and thereby restricting movement of said can; and abutting means affixed to said support band in a manner whereby said abutting means is substantially parallel to and movable substantially parallel relative to said support band into abutment with a rung of said ladder thereby stabilizing the position of said supporting device and said can.

2. A can supporting device for supporting a can from a rung of a ladder used in a manner whereby the side rails of said ladder abut a substantially upright supporting surface, said device comprising a support band of substantially L configuration having first and second arms, the first arm having a hooked free end for hooking onto a rung of said ladder and the second arm having a free end, said free end of said second arm having means for retaining a can resting on said second arm whereby a can is supportable on said second arm;

a substantially circular band affixed to said first arm of said support band for encircling and thereby restricting movement of said can;

a bracket member extending adjacent and substantially parallel to said second arm of said support band;

clamping means for slidably mounting said bracket member against the undersurface of said second arm of said support member in a manner whereby said bracket member is adjustably extendible beyond said first and second arms; and fastening means affixed to said first arm of said support band for releasably fastening said bracket member in position relative to said support member whereby a user adjusts said bracket member in position to abut a rung of said ladder and releasably fastens said bracket member in position thereby stabilizing the position of said supporting device and said can.

3. A can supporting device as claimed in claim 2, wherein said bracket member has a first arm slidably mounted in said clamping means adjacent and parallel to said second arm of said support band, said first arm having a first end in said clamping means and a spaced opposite second end spaced from said first arm of said support band.

4. A can supporting device as claimed in claim 3, further comprising a substantially L-shaped end member on the second end of the first arm of said bracket member, said end member having a first arm conjoint with said first arm of said bracket member and a second arm substantially parallel to and spaced from said first arm of said support band.

5. A can supporting device as claimed in claim 3, further comprising latch means affixed to said circular band for releasably securing said can on said second arm.

6. A can supporting device for supporting a can from a rung of a ladder, said device comprising a support band of substantially L configuration having a substantially vertical arm having a free end with a hook formed therein and a substantially horizontal arm extending from the opposite end of said substantially vertical arm, said substantially horizontal arm having a free end;

a substantially L-shaped first end member on the free end of said substantially horizontal arm, said first end member having a first arm conjoint with said substantially horizontal arm of said support band and a second arm substantially parallel to and spaced from said substantially vertical arm of said support band;

a substantially circular band affixed to said substantially vertical arm of said support band for encircling and thereby restricting movement of a can;

clamping means on said substantially horizontal arm of said support band;

a bracket member movably mounted in said clamping means, said bracket member having a first arm movably mounted in said clamping means adjacent and parallel to said substantially horizontal arm of said support band, said first arm having a first end in said clamping means and a spaced opposite second end spaced from said substantially vertical arm of said support band;

a substantially L-shaped second end member on the second end of the first arm of said bracket member, said second end member having a first arm conjoint with said first arm of said bracket member and a second arm substantially parallel to and spaced from said substantially vertical arm of said support band; and fastening means affixed to said substantially vertical arm of said support band in operative proximity with said bracket member for releasably fastening said bracket member in position relative to said support band, whereby when a can is placed within said circular band and resting on said substantially horizontal arm of said support band and said ladder is used by a user who leans the side rails of said ladder against a substantially upright supporting surface, said hook is hooked on a rung of said ladder and the user manually adjusts the position of said bracket member so that said second end member abuts a rung of said ladder and manually releasably fastens said bracket member in position by manually operating said fastening means thereby stabilizing the position of said supporting device and said can.

7. A can supporting device as claimed in claim 6, further comprising latch means affixed to said circular band for releasably securing said can on said substantially horizontal arm of said support band.

8. A can supporting device for supporting a can from a rung of a ladder used in a manner whereby the side rails of said ladder abut a substantially upright supporting surface, said device comprising a support band of substantially L configuration having first and second arms, the first arm having a hooked free end for hooking onto a rung of said ladder and the second arm having a free end, said free end of said second arm having means for retaining a can resting on said second arm, said first arm of said support band being substantially vertical and said second arm of said support band being substantially horizontal;

a substantially circular band affixed to said first arm of said support band for encircling and thereby restricting movement of said can;

abutting means affixed to said support band in a manner whereby said abutting means is movable relative to said support band into abutment with a rung of said ladder thereby stabilizing the position of said supporting device and said can, said abutting means comprising a member extending adjacent and substantially parallel to said second arm of said support band; and mounting means for slidably mounting said member against the undersurface of said second arm of said support member in a manner whereby said member is adjustably extendible beyond said first and second arms and is releasably fastened in a desired position.

9. A can supporting device as claimed in claim 8, further comprising latch means affixed to said circular band for releasably securing said can on said second arm.

10. A can supporting device for supporting a can from a rung of a ladder used in a manner whereby the side rails of said ladder abut a substantially upright supporting surface, said device comprising a support band of substantially L configuration having first and second arms, the first arm having a hooked free end for hooking onto a rung of said ladder and the second arm having a free end, said free end of said second arm having means for retaining a can resting on said second arm, said first arm of said support band being substantially vertical and said second arm of said support band being substantially horizontal;

a substantially circular band affixed to said first arm of said support band for encircling and thereby restricting movement of said can;

abutting means affixed to said support band in a manner whereby said abutting means is movable relative to said support band into abutment with a rung of said ladder thereby stabilizing the position of said supporting device and said can;

can retaining means at the free end of said second arm of said support band for retaining a can resting on said second arm.

* * * * *